US009353542B2

(12) United States Patent
Chouraqui et al.

(10) Patent No.: US 9,353,542 B2
(45) Date of Patent: May 31, 2016

(54) METHOD OF CLEANING A POOL WITH A ROBOT

(71) Applicant: HEXAGONE, Argenteuil (FR)

(72) Inventors: Yoann Chouraqui, Argenteuil (FR); Damien Dumontier, Argenteuil (FR)

(73) Assignee: HEXAGONE MANUFACTURE SAS, Argenteuil (FR)

( * ) Notice: Subject to any disclaimer, the term of this patent is extended or adjusted under 35 U.S.C. 154(b) by 139 days.

(21) Appl. No.: 14/328,836

(22) Filed: Jul. 11, 2014

(65) Prior Publication Data

US 2015/0027959 A1 Jan. 29, 2015

(30) Foreign Application Priority Data

Jul. 11, 2013 (FR) ..... 13 56818

(51) Int. Cl.
*E04H 4/16* (2006.01)

(52) U.S. Cl.
CPC ..... *E04H 4/1654* (2013.01); *Y10S 901/01* (2013.01)

(58) Field of Classification Search
CPC ..... E04H 4/1654; Y10S 901/01
USPC ..... 210/167.16, 167.17, 143; 15/1.7
See application file for complete search history.

(56) References Cited

U.S. PATENT DOCUMENTS

| | | | | |
|---|---|---|---|---|
| 3,676,884 | A * | 7/1972 | Wulc | E04H 4/1654 15/1.7 |
| 4,154,680 | A * | 5/1979 | Sommer | E04H 4/1654 15/1.7 |
| 5,337,434 | A * | 8/1994 | Erlich | E04H 4/1654 15/1.7 |
| 5,569,371 | A | 10/1996 | Perling | |
| 6,473,927 | B1 * | 11/2002 | Sommer | E04H 4/1654 15/1.7 |
| 2003/0102014 | A1 | 6/2003 | Yoshino et al. | |
| 2006/0101596 | A1 * | 5/2006 | Hui | E04H 4/1654 15/1.7 |
| 2011/0049023 | A1 * | 3/2011 | Hui | E04H 4/1654 210/91 |

OTHER PUBLICATIONS

French Search Report, dated Apr. 17, 2014, of FR 1356818.

* cited by examiner

*Primary Examiner* — Fred Prince
(74) *Attorney, Agent, or Firm* — Bachman & LaPointe, P.C.

(57) ABSTRACT

A method, for cleaning a pool with N vertical walls using a robot, comprising adjusting the robot against the vertical wall of rank n=1. The robot advances along the vertical wall of rank n until the vertical wall of rank n+1 is detected. The robot retracts over a release distance in order to be released from the vertical wall of rank n+1. The robot makes a rotation on itself in order to be adjusted against the vertical wall of rank n+1. Checking whether n is equal to N, in the negative case, the cleaning method continues with an incrementation step where "n" is incremented by "1", and—then looping onto the advancement step. In the positive case, the cleaning method continues with a finishing step where the robot advances along the vertical wall of rank "1" until the vertical wall of rank "2" is detected.

9 Claims, 1 Drawing Sheet

METHOD OF CLEANING A POOL WITH A ROBOT

BACKGROUND

The present invention concerns a method for cleaning a pool by means of a robot, as well as a robot implementing such a method.

The cleaning of a pool, such as a swimming pool, is generally done by means of a robot that runs on the bottom of the swimming pool and sucks in the water and impurities in order to eject only water after filtration. The movement of the robot is either controlled remotely by an operator, or achieved automatically.

In the latter case, either the robot moves in a random manner or the robot comes into contact with a vertical wall, does a half-turn and returns towards the opposite vertical wall and so on.

Such movements are not satisfactory since the cleaning of the corners between the bottom and the vertical walls is not done correctly, whereas the majority of impurities are lodged in these corners.

SUMMARY

One object of the present invention is to propose a cleaning method that does not have the drawbacks of the prior art and in particular affords better cleaning of the corners between the bottom and the vertical walls.

To this end, there is proposed a method for cleaning a pool comprising a bottom and N vertical walls by means of a robot comprising a contact detector and a chassis on which a set of left-hand wheels and a set of right-hand wheels are mounted, each set being rotated by a motor controlled by a control unit, the cleaning method comprising:

- an adjustment step during which the control unit controls the motors in order to adjust the robot against the vertical wall of rank n=1,
- an advancement step during which the control unit controls the motors in order to advance the robot along the vertical wall of rank n until the vertical wall of rank n+1 is detected by the contact detector,
- a release step during which the control unit controls the motors in order to withdraw the robot over a release distance in order to be released from the vertical wall of rank n+1,
- a rotation step during which the control unit controls the motors to make the robot rotate on itself in order to be adjusted against the vertical wall of rank n+1,
- a test step during which the control unit checks whether n is equal to N, when n is different from N, the cleaning method continues with:

- an incrementation step during which the control unit increments the value of n by "1", and
- a looping during which the cleaning method loops onto the advancement step, when n is equal to N, the cleaning method continues with:

- a finishing step during which the control unit controls the motors in order to advance the robot along the vertical wall of rank "1" until the vertical wall of rank "2" is detected by the contact detector,
- a stop step.

Advantageously, during the advancement and finishing steps, the control unit forces the robot to run against the vertical wall.

According to a particular embodiment, the control unit controls each motor so that the speed of the wheels that are against the vertical wall is less than the speed of the wheels that are not against the vertical wall.

According to a particular embodiment, the robot comprises a gyroscope having an angular offset with respect to the direction of advancement of the robot.

Advantageously, during the rotation step, the angle of rotation is less than the actual angle between the vertical walls.

Advantageously, the robot comprises a distance detector intended to measure the distance between the robot and the vertical wall that it is following and, during the advancement and finishing steps, when the measured distance is greater than a threshold, the control unit controls each motor so that the speed of the wheels that are against the vertical wall is less than the speed of the wheels that are not against the vertical wall.

The invention also proposes a robot intended to clean a pool comprising a bottom and N vertical walls, and comprising a contact detector and a chassis on which a set of left-hand wheels and a set of right-hand wheels are mounted, each set being rotated by a motor controlled by a control unit, said robot being such that:

- the control unit is designed to control the motors in order to adjust the robot against a vertical wall,
- the control unit is designed to control the motors so as to advance the robot along a vertical wall as long as the contact detector detects no contact,
- the control unit is designed to control the motors in order to withdraw the robot over a release distance when the contact detector detects a contact,
- the control unit is designed to control the motors in order to make the robot rotate on itself after the release,
- the control unit is designed to check whether n is equal to N, when n is different from N:

- the control unit is designed to increment the value of n by "1", and when n is equal to N:
- the control unit is designed to control the motors in order to advance the robot along a vertical wall as long as the contact detector detects no contact.

Advantageously, the robot comprises a gyroscope having an angular offset with respect to the direction of advancement of the robot.

Advantageously, the robot comprises a contact roller with a vertical rotation axis intended to provide contact against the vertical wall.

BRIEF DESCRIPTION OF THE DRAWINGS

The features of the invention mentioned above, as well as others, will emerge more clearly from a reading of the following description of an example embodiment, said description being made in relation to the accompanying drawings, among which.

In the following description, the terms relating to a position are taken with reference to a pool implanted in the ground.

DETAILED DESCRIPTION

Figure 1:
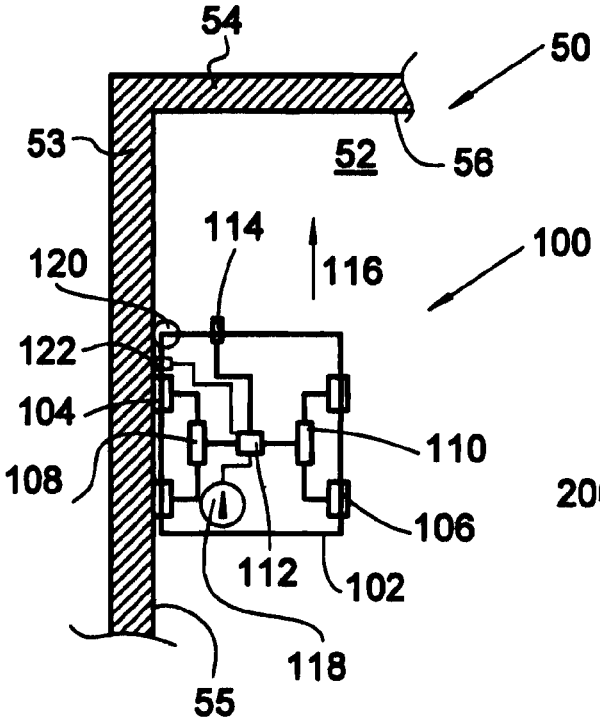
FIG. 1 shows a plan view of a pool.

FIG. 1 shows a pool 50 filled with water, which comprises a bottom 52, delimited by N vertical walls 53 and 54, thus forming, between the bottom 52 and each vertical wall 53, 54, a corner 55, 56. Conventionally N is equal to 4, but N may take other values when the pool 50 is not rectangular. N is greater than or equal to 4.

Figure 3:
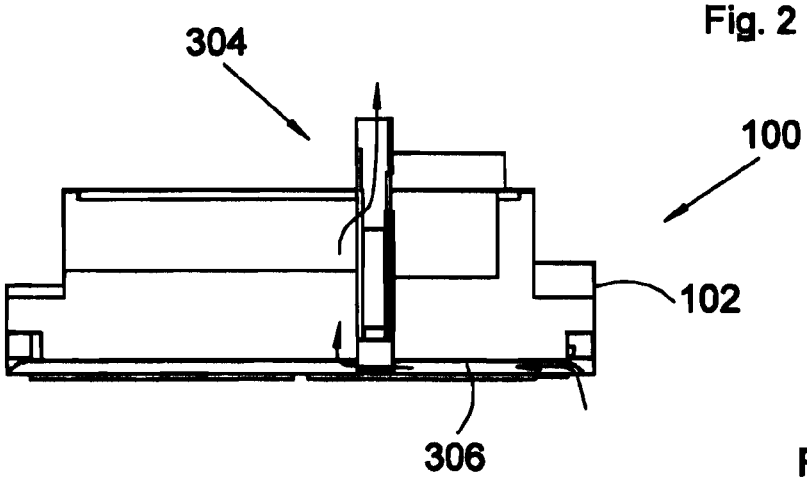
FIG. 3 shows a view in cross section of a robot according to the invention.

The cleaning of the pool 50 is done by a robot 100 that comprises a chassis 102, wheels 104 and 106, motors 108 and 110, a control unit 112, a contact detector 114 and a suction system 304 (FIG. 3).

There is a set of left-hand wheels 104 and a set of right-hand wheels 106 and each set is rotated by a motor, respectively referenced 108, 110.

Each motor 108, 110 is controlled independently by the control unit 112, in which moreover the number N of vertical walls 53, 54 is stored.

The contact detector 114 is disposed at the front of the chassis 102 and informs the control unit 112 when the robot 100 encounters an obstacle in front.

The direction of advancement of the robot 100 is shown by the arrow 116.

The suction system sucks the water and impurities at the base of the chassis 102 and ejects only water after filtration.

FIG. 3 shows a view in cross section of the robot 100. Under the chassis 102 a channel 306 is produced that emerges through a first end on the side of the chassis 102 and under the chassis 102 and through the second end at the suction system 304.

The water and impurities are sucked by the first end through the channel 306 and then pass through suitable filters, which retain the impurities, and the water is ejected outside the robot 100. The arrows in FIG. 3 show the movement of suction and ejection of the water by the suction system 304.

Figure 2:
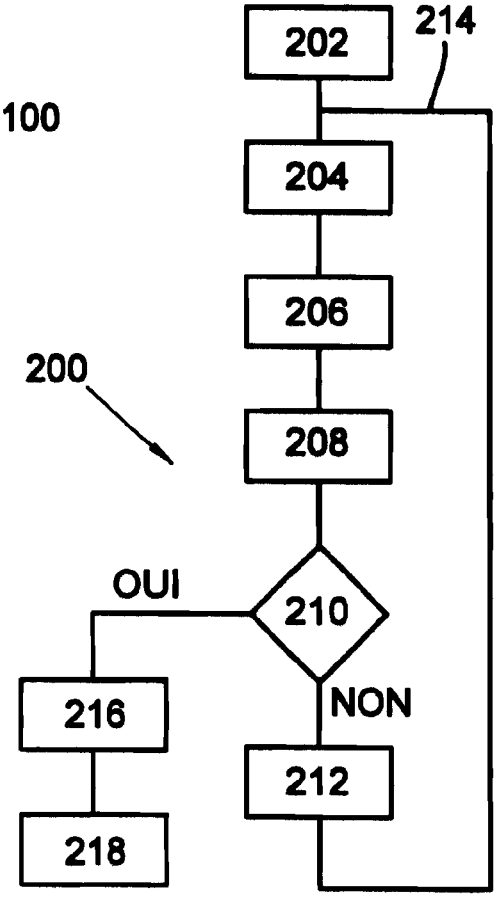
FIG. 2 is an algorithm of a cleaning method according to the invention.

FIG. 2 shows an algorithm of a cleaning method 200 according to the invention.

To effect an improved cleaning of the corners 55 and 56, the principle of the cleaning method 200 is based on the fact that the robot 100 successively follows all the corners 55 and 56 until the complete turn of the pool 50 is made.

In the embodiment of the invention presented here, the robot 100 progresses along the vertical walls 53 and 54 leaving them on the left since the suction system has a suction nozzle positioned at the base and on the left of the chassis 102, but it is possible to place the suction nozzle on the right of the chassis 102 and the robot 100 will then progress along the vertical walls 53 and 54 leaving them on the right.

In more detail, the cleaning method 200 consists of adjusting the robot 100 against a vertical wall 53, following this vertical wall 53, detecting the following vertical wall 54 by means of the contact detector 114, effecting a rotation to adjust the robot 100 along this following vertical wall 54, following this following vertical wall 54 and so on until the complete turn of the pool 50 is made. The robot 100 is adjusted against a vertical wall 53, 54 when the side of the robot 100 is pressed against said vertical wall 53, 54, that is to say here when the left-hand wheels 104 are against the vertical wall 53, 54.

The cleaning method 200 comprises:

an adjustment step 202 during which the control unit 112 controls the motors 108 and 110 so as to adjust the robot 100 against the vertical wall of rank n=1, here the vertical wall referenced 53 for example, an advancement step 204 during which the control unit 112 controls the motors 108 and 110 so as to advance the robot 100 along the vertical wall of rank n in the advancement direction 116, until the vertical wall of rank n+1 (here the vertical wall referenced 54) is detected by the contact detector 114, a release step 206 during which the control unit 112 controls the motors 108 and 110 in order to withdraw the robot 100 in the direction opposite to the advancement direction 116, over a release distance so as to be released from the vertical wall of rank n+1, a rotation step 208 during which the control unit 112 controls the motors 108 and 110 so as to make the robot 100 rotate on itself in order to be adjusted against the vertical wall of rank n+1; here the rotation is effected to the right in order to come against the vertical wall referenced 54, for example by making the left-hand wheels 104 that are against the vertical wall 53, 54 turn forwards and by making the right-hand wheels 106 that are not against a vertical wall 53, 54 turn backwards, a test step 210 during which the control unit 112 checks whether n is equal to N, when n is different from N, the cleaning method 200 continues with:

an incrementation step 212 during which the control unit 112 increments the value of n by "1", and a looping 214 during which the cleaning method 200 loops onto the advancement step 204, when n is equal to N, the cleaning method 200 continues with:

a finishing step 216 during which the control unit 112 controls the motors 108 and 110 in order to advance the robot 100 along the vertical wall of rank "1" (here the vertical wall referenced 53) in the direction of advancement 116, until the vertical wall of rank "2" (here the vertical wall referenced 54) is detected by the contact detector 114, and a stop step 218.

The finishing step 216 completes the cleaning of the corner 55 of the first vertical wall 53 where the cleaning has begun along this first vertical wall 53 rather than at the start thereof.

The set of corners 55, 56 is thus perfectly cleaned.

All the maneuvers are controlled by the control unit 112, which receives information from the contact detector 114 and controls the motors 108 and 110.

The release step 206 withdraws the robot 100 from the vertical wall 54 with which it is contact from the front, so as to enable it then to be rotated without risk of contact with this vertical wall 54. The release distance therefore depends on the footprint of the robot 100.

After the stop step 218, the robot 100 can start in another cleaning cycle, for example in order to clean the rest of the bottom 52.

Thus the control unit 112 is designed:

to control the motors 108 and 110 in order to adjust the robot 100 against a vertical wall (here the vertical wall of rank 1, 53), to control the motors 108 and 110 in order to advance the robot 100 along a vertical wall (first of all the vertical wall of rank 1 and then the following vertical walls of rank "n") as long as the contact detector 114 does not detect any contact (that is to say with the vertical wall of rank "n+1"), to control the motors 108 and 110 in order to withdraw the robot 100 over a release distance when the contact detector 114 detects a contact in order to release the robot 100 from the vertical wall of rank n+1, to control the motors 108 and 110 in order to make the robot 100 rotate on itself after the release and to adjust the robot 100 against the vertical wall of rank n+1, to check whether n is equal to N, when n is different from N:

to increment the value of n by "1", and when n is equal to N:

to control the motors 108 and 110 in order to advance the robot 100 along a vertical wall (here the vertical wall of rank "1", 53) as long as the contact detector 114 does not detect any contact.

The robot 100 comprises interface means, for example of the keypad type, which make it possible to store in the control unit 112 the number N of vertical walls 53, 54, and the rotation angle or angles.

If each rotation angle is identical, only this value can be stored and the cleaning can start from any vertical wall 53, 54. At each rotation step 208, the control unit 112 reads the value of the rotation angle and then makes the corresponding rotation.

If the rotation angles are not all identical, the series of rotation angles can be stored and the cleaning will then always begin from the same vertical wall 53, 54 in order to follow the series. At each rotation step 208, the control unit 112 reads, from the series of rotation angles, the value of the rotation angle corresponding to its position in the pool 50, that is to say with respect to the vertical wall 54 that it has reached, and it then performs the corresponding rotation.

Because errors of parallelism both between the vertical walls 53, 54 and the wheels 104 and 106 of the robot 100, and to ensure that the robot 100 does indeed follow each vertical wall 53, 54 as closely as possible, the robot 100 is forced to run against the vertical wall 53, 54 by the control unit 112, which causes it to run crabwise during the advancement 204 and finishing 216 steps, more particularly against the vertical wall of rank "n" during the advancement step 204 and against the wall of rank "1" during the finishing step 216.

This forcing is achieved for example by a rotation speed of the wheels 104 that are against the vertical wall 53, 54 less than that of the wheels 106 that are not against the vertical wall 53, 54. In this embodiment, the control unit 112 therefore controls the motor 108 of the wheels 104 that are against the vertical wall 53, 54 and the motor 110 of the wheels 106 that are not against the vertical wall 53, 54 in order to obtain a speed of the wheels 104 that are against the vertical wall 53, 54 lower than that of the wheels 106 that are not against the vertical wall 53, 54. Such a difference in speed is for example around 15%.

This forcing can also be achieved by installing, in the robot 100, a gyroscope 118 having an angular offset with respect to the direction of advancement 116 of the robot 100. This angular offset is for example around 7° oriented towards the vertical wall 53, 54. When the robot 100 then follows the direction given by the gyroscope 118, it comes into contact with the vertical wall 53, 54 because of the angular offset.

In order to ensure a regular movement of the robot 100 along the vertical wall 53, 54, the robot has a contact roller 120 with a vertical rotation axis that provides contact against the vertical wall 53, 54 and running of the robot 100 on the vertical wall 53, 54.

To ensure that, after the rotation step 208, the robot 100 is already forced against a vertical wall 53, 54 to be followed, the rotation angle is less than the actual angle between the vertical walls 53 and 54 at the rotation, for example by around 10°. For example, when the pool 50 is rectangular, each rotation takes place over an angle of approximately 80°.

To ensure also better following of the vertical walls 53 and 54 by the robot 100, for example in the case of a pool 50 with free shapes, the robot 100 also has a distance detector 122 that is mounted on the chassis 102 and enables the control unit 112 to measure the distance between the robot 100 and the vertical wall 53, 54 that it is following.

The distance detector 122 may for example be a mechanical or electrical sensor.

If, during the advancement 204 and finishing 216 steps, the distance detector 122 measures a distance greater than a threshold, the control unit 112 controls each motor 108, 110 so that the speed of the wheels 104 that are against the vertical wall 53, 54 is less than the speed of the wheels 106 that are not against the vertical wall 53, 54.

Naturally the present invention is not limited to the examples and embodiments described and depicted but is capable of numerous variants accessible to a person skilled in the art.

The invention claimed is:

1. A method for cleaning a pool comprising a bottom and N vertical walls by means of a robot comprising a contact detector and a chassis on which a set of left-hand wheels having a left motor and a set of right-hand wheels having a right motor are mounted, each set being rotated by each respective motor controlled by a control unit, the cleaning method comprising:

adjusting the robot comprising controlling the motor associated with the set of left-hand wheels and the motor associated with the set of right-hand wheels with the control unit in order to adjust the robot against a vertical wall of rank n=1, advancing the robot comprising controlling the motor associated with the set of left-hand wheels and the motor associated with the set of right-hand wheels with the control unit in order to advance the robot along the vertical wall of rank n=1 until a vertical wall of rank n+1 is detected by the contact detector, releasing the robot comprising controlling the motor associated with the set of left-hand wheels and the motor associated with the set of right-hand wheels with the control unit in order to withdraw the robot over a release distance in order to be released from the vertical wall of rank n+1, rotating the robot comprising controlling the motor associated with the set of left-hand wheels and the motor associated with the set of right-hand wheels with the control unit to make the robot rotate on itself in order to be adjusted against the vertical wall of rank n+1, testing the walls wherein the control unit checks whether n is equal to N, when n is different from N, the cleaning method further comprises:

incrementing the value of n wherein the control unit increments the value of n by "1", and looping to the advancing the robot step wherein the cleaning method loops onto the advancement step, when n is equal to N, the cleaning method continues with:

finishing the method wherein the control unit controls the motors in order to advance the robot along the vertical wall of rank "1" until the vertical wall of rank "2" is detected by the contact detector, and stopping the cleaning method.

2. The Cleaning method according to claim 1, wherein during the advancing and finishing steps, the control unit forces the robot to run against the vertical wall.

3. The cleaning method according to claim 1, wherein the control unit controls each of the motor associated with the set of left-hand wheels and the motor associated with the set of right-hand wheels so that the speed of the wheels that are against the vertical wall is less than the speed of the wheels that are not against the vertical wall.

4. The cleaning method according to claim 2, wherein the robot comprises a gyroscope having an angular offset with respect to a direction of advancement of the robot.

5. The cleaning method according to claim 1, wherein during the rotating step, the rotation angle is less than the actual angle between the vertical walls.

6. The cleaning method according to claim 1, wherein the robot comprises a distance detector configured to measure the distance between the robot and the vertical wall that the robot is following, and in that, during the advancing and finishing steps, when the distance measured is greater than a threshold, the control unit controls each of the motor associated with the set of left-hand wheels and the motor associated with the set of right-hand wheels wherein the speed of the wheels that are against the vertical wall is less than the speed of the wheels that are not against the vertical wall.

7. A robot configured to clean a pool comprising a bottom and N vertical walls, and comprising a contact detector and a chassis on which a set of left-hand wheels and a set of right-hand wheels are mounted, each set being rotated by a motor controlled by a control unit, said robot comprising:

the control unit being configured to control the motors associated with each set of wheels in order to adjust the robot against a vertical wall, the control unit being configured to control the motors associated with each set of wheels so as to advance the robot along a vertical wall as long as the contact detector detects no contact, the control unit being configured to control the motors associated with each set of wheels in order to withdraw the robot over a release distance when the contact detector detects a contact, the control unit being configured to control the motors associated with each set of wheels in order to make the robot rotate on itself after the release, the control unit being configured to check whether n is equal to N, when n is different from N:

the control unit being configured to increment the value of n by "1", and when n is equal to N:

the control unit being configured to control the motors associated with each set of wheels in order to advance the robot along a vertical wall as long as the contact detector detects no contact.

8. The robot according to claim 7, wherein the robot further comprises a gyroscope having an angular offset with respect to the direction of advancement of the robot.

9. The robot according to claim 7, wherein the robot further comprises a contact roller with a vertical rotation axis configured to provide contact against the vertical wall.

* * * * *